United States Patent [19]

Kisaichi et al.

[11] 4,238,193

[45] Dec. 9, 1980

[54] METHOD OF TREATING SYNTHETIC FIBERS OR SYNTHETIC FIBER FABRICS

[75] Inventors: Akio Kisaichi, Nagahama; Masao Oguchi, Suita; Toshihide Takeda, Nagahama; Akira Aikawa, Nagahama; Toshio Saito, Nagahama, all of Japan

[73] Assignee: Kanebo, Ltd., Tokyo, Japan

[21] Appl. No.: 943,707

[22] Filed: Sep. 19, 1978

[30] Foreign Application Priority Data

Sep. 20, 1977 [JP] Japan ..... 52-113637

[51] Int. Cl.[3] ..... C08L 51/06; C08L 51/08

[52] U.S. Cl. ..... 8/115.5; 8/DIG. 4; 8/DIG. 9; 8/DIG. 10; 8/DIG. 18; 8/DIG. 21; 525/59; 525/165; 525/178; 525/243; 525/244; 525/245; 525/246; 525/247

[58] Field of Search ..... 8/115.5, DIG. 18, DIG. 4, 8/DIG. 9, DIG. 10, DIG. 21; 260/877; 525/59, 165, 178, 243, 244, 245, 246, 247

[56] References Cited

U.S. PATENT DOCUMENTS

| | | | |
|---|---|---|---|
| 2,907,675 | 10/1959 | Gaylord | 260/877 |
| 3,046,078 | 7/1962 | Salsbury et al. | 260/877 |

FOREIGN PATENT DOCUMENTS

| | | | |
|---|---|---|---|
| 819651 | 9/1959 | United Kingdom | 260/877 |
| 878523 | 10/1961 | United Kingdom | 260/877 |
| 901038 | 7/1962 | United Kingdom | 260/877 |

OTHER PUBLICATIONS

Chemical Abstracts, vol. 82, No. 12, Mar. 24, 1975, p. 74381q.

*Primary Examiner*—Ronald W. Griffin
*Attorney, Agent, or Firm*—Blanchard, Flynn, Thiel, Boutell & Tanis

[57] ABSTRACT

Durable excellent water absorption property and anti-static property can be given to synthetic fiber by a simple method. In the method, a polymerization initiator is absorbed in the fiber and then the fiber is applied with a water-soluble polymerizable monomer and heat treated to form a polymer thereon.

13 Claims, No Drawings

METHOD OF TREATING SYNTHETIC FIBERS OR SYNTHETIC FIBER FABRICS

BACKGROUND OF THE INVENTION

1. Field of the Invention

The present invention relates to a method of treating synthetic fiber, and more particularly, to an improved method of giving a water absorption property and an antistatic property to synthetic fiber by treating the fiber with a water-soluble polymerizable monomer and its polymerization initiator. In the specification and claims, the term "synthetic fiber" means synthetic fiber and synthetic fiber fabric, and may be merely referred to as fiber.

2. Description of the Prior Art

A so-called graft polymerization modification method is known in which synthetic fiber is treated with a treating liquid containing a water-soluble polymerizable monomer, such as acrylic acid, acrylic acid amide or the like, and its polymerization initiator to give a water absorption property, an antistatic property and the like to the fiber. The inventors have already proposed in Japanese Patent Application Publication No. 30,640/76 a method of treating a synthetic fiber with a treating liquid containing an acrylamide derivative, such as N,N'-methylene-bis-acrylamide or the like, an acid and a polymerization initiator. According to that method, a durable antistatic property, water absorption property and hygroscopicity and an excellent feel can be given to synthetic fiber at the same time.

However, in those methods, since the one-bath immersion treating method, wherein synthetic fiber is treated in a bath containing both monomer and polymerization initiator, is generally used, a large amount of homopolymer is formed in the bath due to the self-polymerization of the monomer before a polymer film is formed on the fiber, and the homopolymer adheres to the fiber to deteriorate the feel of the fiber and to affect adversely the treating effect, and further the homopolymer contaminates the treating apparatus. Therefore, not only the cleaning of the treating apparatus is troublesome, but also the production of the treated fiber is expensive due to the loss of monomer. In a method wherein synthetic fiber is applied with the above described treating liquid containing both monomer and polymerization initiator by padding or spraying and then is heat treated, the treating liquid is not sufficiently stable, and homopolymer is formed in the treating liquid due to a slight rise of the temperature after the treating liquid is produced. Further, when the treating liquid contains acid, the polymerization initiator is decomposed due to the action of the acid and a small amount of metal ions contained in the water used, and the catalytic action of the polymerization initiator often lowers with the passing of time. Therefore, polymer is not uniformly formed on the fiber, the treating effect varies, and continuous production of treated fiber having uniform antistatic property and water absorption property is difficult.

Moreover, in the conventional methods, it is difficult for the monomer to penetrate into the interior of fiber and to form a polymer in the interior of the fiber. As a result, retention of the polymer in the fiber is reduced, and the treated fiber is always unsatisfactory in the durability of the antistatic property and water absorption property.

SUMMARY OF THE INVENTION

The present invention relates to an improvement of the above described conventional treating methods of fiber, which are carried out by the use of water-soluble polymerizable monomer and polymerization initiator.

That is, an object of the present invention is to provide a method of treating fiber, which is substantially free from the formation of homopolymer and the deterioration of the property of the polymerization initiator during the treating step, and is remarkably superior to the conventional methods in the stability of treatment, workability and cost saving.

Another object of the present invention is to provide a method of giving a durable excellent water absorption property and an antistatic property to synthetic fiber.

A further object of the present invention is to provide a method of giving an excellent natural fiber-like crisp feel to synthetic fiber.

The above described objects can be attained by a method of treating synthetic fiber with a water-soluble polymerizable monomer, wherein the improvement comprises applying an aqueous solution or dispersion containing a polymerization initiator for the monomer to the fiber, heat treating the fiber to absorb the polymerization initiator to the fiber, washing the fiber with water, then applying an aqueous monomer solution containing at least one water-soluble polymerizable monomer and having a pH of not higher than 6 to the above treated fiber, and heat treating the fiber.

That is, the essential feature of the present invention lies in that a polymerization initiator for the monomer is applied to the fiber in an aqueous system and is absorbed in the interior of the fiber prior to the monomer treatment, and that the polymerization initiator remaining on the fiber surface is removed by washing the fiber with water. As the result, at the monomer treatment, a major part of the polymerization reaction proceeds directly on the fiber surface and a part of the reaction proceeds in the interior of the fiber due to the penetration of the monomer into the interior of the fiber. Therefore, useless homopolymer neither forms nor separates out in the treating bath and in the space between the fibers, and the durability of the polymer film formed on the fiber surface is remarkably improved due to the anchoring effect of the polymer partly formed in the interior of the fiber, and an excellent water absorption property and antistatic property are given to the fiber by the hydrophilic polymer formed by the polymerization of the water-soluble polymerizable monomer.

In the present invention, all treating steps inclusive of the above described polymerization initiator absorption step and monomer treatment step are carried out in an aqueous system, and the present invention provides a commercially advantageous and simple method. There has been attempted, in order to improve the graft efficiency of the polymerizable monomer to the synthetic fiber, a method wherein a polymerization initiator is penetrated into the interior of the fiber in the presence of swelling agents, such as methanol, acetic acid, benzyl alcohol, etc., and then a monomer treatment is carried out. However, in this method, the handling of the swelling agent is troublesome, and this method is very difficult to carry out on a commercial scale and is inferior in the effect to the present invention.

DESCRIPTION OF THE PREFERRED EMBODIMENTS

The synthetic fiber to be used in the present invention includes polyamide fiber, polyester fiber, polyacrylonitrile fiber, polyvinyl alcohol fiber, polypropylene fiber, polyethylene fiber, polyvinyl chloride fiber, polyvinylidene chloride fiber and the like. Any staple fiber and filament can be used. The synthetic fiber fabric includes yarn, woven fabric, knitted fabric, non-woven fabric, flocked fabric and the like, which consist of at least one of the above described various synthetic fibers. The synthetic fiber fabric may further contain natural fiber and/or regenerated cellulose fiber.

The above described synthetic fibers and synthetic fiber fabrics are referred to as synthetic fiber in the specification and claims as defined before.

The water-soluble polymerizable monomer to be used in the treatment of the synthetic fibers includes acrylic acid, acrylic acid amind, N,N'-methylene-bis-acrylamide, N,N'-methylene-bis-methacrylamide, 1,3,5-triacryloylhexahydro-1,3,5-triazine, 1,3,5-trimethacryloylhexahydro-1,3,5-triazine, polyalkylene glycol diacrylate, polyalkylene glycol dimethacrylate, bis-polyoxyethylenated bisphenol A diacrylate and the like. Among them, N,N'-methylene-bis-acrylamide and 1,3,5-triacryloylhexahydro-1,3,5-triazine are particularly preferable, because they give an excellent natural fiber-like crisp feeling and durable excellent antistatic property and water absorption property to synthetic fiber.

As the polymerization initiator to be applied to synthetic fiber before the fiber is treated with the above described monomer, compounds having an excellent heat stability are generally and preferably used in view of the absorption treatment of the initiator by heating, which will be explained later. These compounds are, for example, peroxides, such as benzoyl peroxide, t-butylperoxy maleic acid, t-butyl hydroperoxide and the like; cerium ammonium salts, such as ammonium ceric sulfate, ammonium ceric nitrate and the like; azoisobutyronitrile and the like. Among them, cerium ammonium salts are preferably used in the present invention. Cerium ammonium salts have the following merits that (1) the salt is particularly excellent in the heat stability and is easily penetrated into the interior of the fiber and retained therein, (2) the polymerization reaction proceeds easily by the use of the salt even at a relatively low temperature, and (3) when the salt absorbed in the interior of the fiber migrates to the fiber surface at the monomer treatment, the migration rate of the salt is properly matched with the penetrating rate of the monomer into the interior of the fiber, and therefore the polymer is more easily formed in the interior of the fiber than in the case where a different polymerization initiator is used, and the durability of the antistatic property and water absorption property of the treated fiber are remarkably improved. The merit of the salt described in the above item 3 appears particularly noticeably when N,N'-methylene-bis-acrylamide or 1,3,5-triacryloylhexahydro-1,3,5-triazine is used as a monomer.

The above described polymerization initiator can be easily absorbed in the synthetic fiber by the following methods, that is, a method wherein the fiber is immersed in an aqueous solution or aqueous dispersion containing the above described polymerization initiator (hereinafter referred to as the polymerization initiator solution) and heat treated therein, or a method wherein the polymerization initiator solution is applied to the synthetic fiber by the mangle pad method, spray method or other method, and then the fiber is subjected, directly or after squeezing, to a heat treatment, that is, to a dry heating or a steaming. Among the above described methods, the immersion method is the most preferable method due to the reason that the polymerization initiator can be uniformly and fully penetrated into synthetic fiber. In general, the polymerization initiator solution having a concentration of 0.002 to 1% by weight is used. In the immersion method, synthetic fiber is immersed in the polymerization initiator solution in a bath ratio of 1/5 to 1/300, and heat treated at a temperature of 60 to 130° C., preferably 80 to 130° C., for 2 to 60 minutes. In the pad method or spray method, after polymerization initiator solution is applied to synthetic fiber, the fiber is subjected to a dry heating at a temperature of 80 to 160° C. for 0.5 to 5 minutes, or to a steaming at 80 to 130° C. for 2 to 30 minutes. When the treating condition is milder than the above defined condition, particularly, when the treating temperature is lower than the above defined temperature, the polymerization initiator is adsorbed merely on the fiber surface and does not penetrate into the interior of the fiber. While, when the treating condition is more severe than the above defined condition, the polymerization initiator and fiber are often damaged. Accordingly, a treating condition outside the above defined range is not preferable.

The amount of polymerization initiator to be retained in the synthetic fiber must be varied depending upon the kind of monomer or the amount of monomer to be applied to the fiber in the monomer treatment explained later, and is generally 0.01 to 5% by weight, preferably 0.05 to 3% by weight, based on the weight of the fiber. When the amount of polymerization initiator retained in the fiber is less than 0.01% by weight, even if a monomer treatment carried out under the condition defined in the present invention, the monomer treatment is not effective. While, even when the retention of polymerization initiator in the fiber exceeds 5% by weight, the effect of the monomer treatment is not so improved and the use of the initiator in such excess amount is wasteful. Moreover, when the retention exceeds 5% by weight, the feel of the treated fiber is apt to be rigid. Therefore, the retention of the initiator must be within the above defined range.

The retention of the polymerization initiator in the synthetic fiber can be easily adjusted to the above described range by adjusting the initiator concentration in the solution and the bath ratio in the immersion method, or by adjusting the initiator concentration in the solution and the amount of the initiator solution to be applied to the fiber in the pad method and spray method, and then by subjecting the fiber to a heat treatment under the above described heat treating condition. The fiber containing the polymerization initiator retained therein is washed with water to remove substantially completely the initiator remaining on the fiber surface. Then, the fiber, directly or after being squeezed and dried, is subjected to a monomer treatment. In this case, if the above described heat treatment has not been sufficiently carried out, a major part of the polymerization initiator exfoliates from the fiber during the water-washing, and the catalytic effect is lost.

The synthetic fiber treated with a polymerization initiator is then subjected to a monomer treatment, wherein an aqueous solution containing at least one of the above described water-soluble polymerizable monomers and having a pH of not higher than 6 is applied to the fiber and then the fiber is heat treated. In this case, since the monomer solution is not sufficiently stable in the neutral or alkaline region, the pH of the solution must be not higher than 6. However, excessively low pH damages occasionally the fiber during the treatment, and therefore selection of pH must be carried out carefully. As the acid to be used in the adjustment of pH, use is made of inorganic acids, such as sulfuric acid, nitric acid, phosphoric acid, hydrochloric acid and the like, and organic acids, such as acetic acid, formic acid, oxalic acid, tartaric acid, malonic acid, monochloroacetic acid, dichloroacetic acid, trichloroacetic acid and the like.

The kind and combination of monomers to be contained in a monomer solution must be properly selected depending upon the treating object of the synthetic fiber, but in general, when any one of the above described monomers is used alone, a sufficiently high water absorption property and antistatic property can be given to the fiber. It has been already described that N,N'-methylene-bis-acrylamide or 1,3,5-triacryloylhexahydro-1,3,5-triazine is a particularly effective monomer in this case.

The application of an aqueous solution of monomer and the heat treatment can be carried out in the same manner as described in the polymerization initiator treatment, but an immersion method, or a method wherein a steaming is carried out after padding or spraying, is generally carried out in view of the antistatic property, water absorption property and feel of the treated fiber. In the dry heating, both the above described properties of the treated fiber and the durability of the antistatic property and water absorption property thereof are apt to be lower.

In the immersion method, the monomer concentration in the aqueous solution and the bath ratio are particularly important. Of course, these condition should be determined depending upon the kind of monomer, the object of treatment, the kind and shape of synthetic fiber to be treated and the like, but a monomer concentration of 0.01–5% by weight and a bath ratio of 1/5–1/300 are generally used. When the concentration is lower than 0.01% by weight, even if the polymerization initiator has been previously applied to the synthetic fiber uniformly in a high concentration, the treated fiber does not have satisfactorily excellent properties. While, when the concentration is higher than 5% by weight, there is a fear that the feel of fiber is deteriorated and the treated fiber is not uniform in the property due to uneven reaction. Further, an extremely low bath ratio also causes unevenness of the properties of the treated fiber.

The treating effect in the pad method or spray method is mainly influenced by the amount of the aqueous monomer solution applied to the synthetic fiber to be treated. In this case, when an aqueous monomer solution having the same concentration as that in the above described immersion method is applied to the fiber so that the applied amount of monomer is 0.01–5% by weight, calculated as solid monomer base, based on the weight of the fiber, a treated fiber having satisfactorily excellent antistatic property, water absorption property and feel can be obtained. The amount of monomer to be applied to the synthetic fiber to be treated should be properly selected within the above described range depending upon the object of treatment, the kind of fiber and the like.

The heat treating temperature used in the monomer treatment is within the range of 50–130° C. in the immersion method and steaming method, and is within the range of 50–170° C. in the dry heating. When the treating temperature is lower than 50° C., although the polymerization occurs, a very long time is required until the polymerization reaction is completed, and the commercial treatment is disadvantageous. While, when the treating temperature is higher than the upper limit of the above described temperature range, such unfavorable phenomena occasionally occur that the fiber is damaged or the polymerization initiator migrates from the fiber into the treating liquid to form useless homopolymer.

Further, in general, it is preferable that the heat treating temperature used in the monomer treatment is equal to or somewhat higher than the heat treating temperature used in the above described polymerization initator treatment. When the monomer treatment temperature is lower than the polymerization initiator treatment temperature, a long time is required in the migration of the polymerization initiator from the interior of the fiber to the fiber surface. While when the monomer treatment temperature is extremely higher than the polymerization initiator treatment temperature, the polymerization initiator is dissolved out in the aqueous monomer solution to form homopolymer therein.

The heat treating time in the monomer treatment must be varied depending upon the amount of monomer to be applied to synthetic fiber, the treating temperature, the kind of the fiber and the like, but the time is generally 10–120 minutes in the immersion method and 0.5–60 minutes in the pad method and spray method.

In the above described monomer treatment, the polymerization initiator previously retained in the interior of synthetic fiber migrates to the fiber surface and a part of the monomer penetrates into the fiber, and hence the polymerization reaction of the monomer directly proceeds mainly on the fiber surface and partly in the interior of the fiber. Therefore, the treatment of the present invention is free from the drawbacks of the conventional treatment, wherein monomers are homopolymerized in the treating bath to form useless homopolymer, and the resulting homopolymer contaminates the apparatus or adheres unevenly to the synthetic fiber to be treated to form water-spot thereon or deteriorates the feel of the fiber. Thus, according to the present invention, treated fiber having excellent antistatic property, water absorption property, appearance and feel can be obtained effectively and inexpensively. Further, the durability of the resulting polymer film is remarkably improved due to the anchoring effect of the polymer partly formed in the interior of fiber, and since the polymer itself has a very high hydrophillic property, the treated fiber has permanent water absorption property and antistatic property.

Moreover, according to the present invention, in addition to the absence of deterioration of feel due to the uneven adhesion of homopolymer as described above, the fiber surface is uniformly coated with a polymer film having projections, and therefore the treated fiber does not have a slimy feel inherent to synthetic fiber, but has a favorable crisp feel similar to natural fiber. This is one of the merits of the present invention. This effect appears particularly remarkably when N,N'-methylene-bis-acrylamide or 1,3,5-triacryloylhexahydro-1,3,5-triazine is used as the monomer.

In the present invention, not only the above described monomer treatment, but also the application of polymerization initiator to the synthetic fiber can be carried out in an aqueous system, and further the polymerization initiator can be retained in the interior of the fiber by a simple heat treatment. Therefore, the method of the present invention provides a very useful method for industrial purpose.

The above treated fiber is squeezed and dried in the case of immersion method, or is heat treated in the case of pad method and spray method, and then can be directly wound up to produce a final product. However, in general, the dried or heat treated fiber is further washed with warm water or cold water to remove unreacted monomer and then squeezed and dried.

The following examples are given for the purpose of illustration of this invention and are not intended as limitations thereof. In the examples, "%" means by weight. The measuring condition of the properties and the washing condition of sample fibers in the following examples are as follows.

(1) Electrification voltage (v):

The electrification voltage of a sample fiber is measured under an atmosphere kept at 20°±2° C. and 53±2% RH and under a load of 500 g and a revolution number of 500 rpm by using cotton shirting No. 3 as a rubbing cloth by means of a static tester developed by the Chemical Institute of Kyoto University and made by Kōa Shōkai Co.

(2) Surface resistance (Ω):

The surface resistance of a sample fiber is measured under an atmosphere kept at 20°±2° C. and 53±2% RH by means of an electrometer made by Takeda Riken Co.

(3) Half-life period (sec):

The half-life period of a sample fiber is measured under an applied voltage of 10 KV and under an atmosphere kept at 20°±2° C. and 53±2% RH by means of a Static Honestometer made by Shishido Shōkai Co.

(4) Water absorption property (sec):

Distilled water is dropped from a buret placed above a sample fiber in a height of 5 cm to the sample fiber surface, and the time until the reflected light on the surface of the water is extinguished is measured.

(5) Washing condition:

Washing: Commercially available anionic synthetic detargent (trademark: New Beads, made by Kaō Soap Co.) 1.3 g/l, Bath ratio 1:50, 50° C.×15 min.

Washing with warm water: 50° C.×15 min.

Washing with cold water: room temperature×30 min.

EXAMPLE 1

A polyester taffeta consisting of polyethylene terephthalate fibers having a fineness of 75 deniers (warp: 102 fibers/inch, weft: 75 fibers/inch) was immersed in a 0.1% aqueous solution of ammonium ceric sulfate (polymerization initiator) in a bath ratio of 1:30, heated from room temperature to 90° C. in 40 minutes under stirring, and heat treated at 90° C. for 30 minutes, taken out from the solution, washed with water and dried. The taffeta was then immersed in an aqueous solution containing 1% of N,N'-methylene-bis-acrylamide as a water-soluble polymerizable monomer, whose pH was previously adjusted to 3 by using phosphoric acid, heated from room temperature to 105° C. in 20 minutes and heat treated at 105° C. for 60 minutes, taken out from the solution, squeezed, washed with water and dried to obtain a treated taffeta (Treated taffeta No. 1 in the present invention).

Further, the same polyester taffeta as used above was subjected to a polymerization initiator treatment under the same condition as described above, and immersed in an aqueous solution containing 1.5% of N,N'-methylene-bis-acrylamide as a water-soluble polymerizable monomer, whose pH was previously adjusted to 2 by using sulfuric acid, at room temperature, after which the taffeta was taken out from the solution, squeezed in a squeezing percentage of 100% and treated with steam at 103° C. for 20 minutes in a continuous steam-treating apparatus. Then, the taffeta was washed with water and dried to obtain a treated taffeta (Treated taffeta No. 2 in the present invention).

For comparison, the same polyester taffeta as described above was immersed in an aqueous solution containing 0.1% of ammonium ceric sulfate and 1% of N,N'-methylene-bis-acrylamide, whose pH was previously adjusted to 3 by using phosphoric acid, and heated from room temperature up to 80° C. in 20 minutes and heat treated at 80° C. for 60 minutes, after which the taffeta was taken out from the solution, squeezed, washed with water and dried to obtain a treated taffeta (Comparative taffeta).

During the above described treatments, the treating bath was always clear and homopolymer was not formed in the bath in the method of the present invention. While in the one-bath treating method (Comparative method), a large amount of homopolymer was formed in the treating bath, and the bath was rice water-like liquid at the end of the treatment.

The above treated taffetas were subjected to 30 times washing, and the properties of the taffetas before and after the washing are shown in the following Table 1 together with properties of untreated taffeta. It can be seen from Table 1 that the taffeta treated in the present invention has an excellent water absorption property and antistatic property and further is remarkably superior in the durability of these properties to the taffeta (Comparative taffeta) treated with the one-bath method.

Table 1

| Sample | Electrification voltage (v) | | Surface resistance (Ω) | | Half-life period (sec) | | Water absorption property (sec) | | Feeling |
|---|---|---|---|---|---|---|---|---|---|
| | Before washing | After 30 times washing | Before washing | After 30 times washing | Before washing | After 30 times washing | Before washing | After 30 times washing | |
| Treated taffeta No. 1 in the present invention | 960 | 1,100 | $4.3 \times 10^9$ | $8.5 \times 10^9$ | 3.6 | 5.2 | 0.4 | 1.0 | Not slimy Excellent |
| Treated taffeta No. 2 in the present | 980 | 1,200 | $4.0 \times 10^9$ | $8.9 \times 10^9$ | 3.0 | 5.6 | 0.4 | 1.2 | Not slimy Excellent |

Table 1-continued

| Sample | Electrification voltage (v) Before washing | Electrification voltage (v) After 30 times washing | Surface resistance (Ω) Before washing | Surface resistance (Ω) After 30 times washing | Half-life period (sec) Before washing | Half-life period (sec) After 30 times washing | Water absorption property (sec) Before washing | Water absorption property (sec) After 30 times washing | Feeling |
|---|---|---|---|---|---|---|---|---|---|
| invention | | | | | | | | | |
| Comparative taffeta | 700 | 2,500 | $4.0 \times 10^9$ | $1.2 \times 10^{11}$ | 3.4 | 9.8 | 0.4 | 3.0 | Not slimy Slightly rigid |
| Untreated taffeta | 7,500 | 7,800 | $2.5 \times 10^{13}$ | $5.4 \times 10^{13}$ | >180 | >180 | >180 | >180 | Slimy |

EXAMPLE 2

A back half tricot consisting of polyethylene terephthalate fibers having a fineness of 30 deniers (warp: 61 fibers/inch, course: 50 fibers/inch, 36 gauge) was immersed in an aqueous solution containing 0.07–10% of ammonium ceric nitrate in a bath ratio of 1:10, heated from room temperature to 90° C. in 40 minutes under stirring, and heat treated at 90° C. for 30 minutes, after which the tricot was taken out from the solution, washed with water and dried to obtain sample tricots having a polymerization initiator retention shown in the following Table 2.

The retention of the polymerization initiator in the sample tricot was measured in the following manner. The amount of cerium retained in a sample tricot was quantitatively analysed by the fluorescent X-ray method, and the measured value of the cerium was converted into the amount of ammonium ceric nitrate.

Then, each of the sample tricots was immersed in an aqueous solution containing 1% of N,N'-methylene-bisacrylamide and having a pH of 3 adjusted by phosphoric acid in a bath ratio of 1:100, heated from room temperature to 105° C. in 20 minutes and heat treated at 105° C. for 60 minutes. Then, the tricot was taken out from the solution, squeezed, washed with water and dried to obtain a treated tricot.

The above treated tricot was further subjected to a washing test, and the physical properties of the tricots before and after the washing test are shown in Table 2.

It can be seen from Table 2 that when the retention of the polymerization initiator in the tricot is lower than 0.01%, the effect of the treatment in the present invention is noticeably low. While, when the retention is higher than 5.0%, the treated tricot has a rigid feeling. Therefore, the retention of the polymerization initiator in the tricot of lower than 0.01% or more than 5.0% is not preferable.

EXAMPLE 3

The same back-half tricot as used in Example 2 was immersed in an aqueous solution containing 0.1% of ammonium ceric nitrate in a bath ratio of 1:10, heated from room temperature up to a heat treating temperature (50°–140° C.) shown in the following Table 3 in 30 minutes, and heat treated at this temperature (50°–140° C.) for 30 minutes. Then, the tricot was taken out from the solution, washed fully with water and dried. After the retention of the polymerization initiator in the tricot was measured in the same manner as described in Example 2, the tricot was immersed in an aqueous solution containing 1% of N,N'-methylene-bis-acrylamide as a water-soluble polymerizable monomer and having a pH of 3 adjusted by the use of phosphoric acid in a bath ratio of 1:100, heated from room temperature up to 105° C. in 20 minutes, heat treated at 105° C. for 40 minutes, squeezed, washed with water and dried to obtain a treated tricot. The above treated tricot was further subjected to a washing test. The physical properties of the above treated tricot before and after the washing test are shown in Table 3.

Table 2

| Retention of initiator (%) | Electrification voltage (v) Before washing | Electrification voltage (v) After 30 times washing | Surface resistance (Ω) Before washing | Surface resistance (Ω) After 30 times washing | Half-life period (sec) Before washing | Half-life period (sec) After 30 times washing | Water absorption property (sec) Before washing | Water absorption property (sec) After 30 times washing | Feeling |
|---|---|---|---|---|---|---|---|---|---|
| 0.005 | 4,500 | 5,500 | $3.2 \times 10^{12}$ | $5.6 \times 10^{12}$ | 18.0 | 23.0 | 3.2 | 6.5 | Slimy |
| 0.01 | 1,200 | 1,500 | $8.5 \times 10^9$ | $1.0 \times 10^{10}$ | 5.5 | 7.3 | 0.4 | 1.2 | Excellent |
| 0.5 | 950 | 1,100 | $4.2 \times 10^9$ | $8.5 \times 10^9$ | 3.6 | 5.2 | 0.4 | 1.0 | Excellent |
| 2.5 | 760 | 950 | $8.5 \times 10^8$ | $4.1 \times 10^9$ | 2.8 | 3.5 | 0.4 | 0.8 | Excellent |
| 5.0 | 750 | 980 | $8.2 \times 10^8$ | $4.3 \times 10^9$ | 2.7 | 3.6 | 0.4 | 0.8 | Somewhat rigid |
| 7.0 | 700 | 800 | $7.0 \times 10^8$ | $9.5 \times 10^8$ | 2.5 | 3.0 | 0.3 | 0.7 | Rigid |

Table 3

| Heat treating temperature (°C.) | Retention of initiator (%) | Electrification voltage (v) Before washing | Electrification voltage (v) After 30 times washing | Surface resistance (Ω) Before washing | Surface resistance (Ω) After 30 times washing | Half-life period (sec) Before washing | Half-life period (sec) After 30 times washing | Water absorption property (sec) Before washing | Water absorption property (sec) After 30 times washing | Feeling |
|---|---|---|---|---|---|---|---|---|---|---|
| 50 | 0.009 | 3,000 | 4,500 | $9.5 \times 10^{11}$ | $3.0 \times 10^{12}$ | 12.0 | 19.0 | 2.8 | 3.2 | Slimy |
| 80 | 0.12 | 1,000 | 1.100 | $7.9 \times 10^9$ | $8.5 \times 10^9$ | 4.9 | 5.2 | 0.9 | 1.0 | Excellent |
| 100 | 0.24 | 900 | 1,100 | $4.0 \times 10^9$ | $8.3 \times 10^9$ | 3.4 | 5.1 | 0.4 | 1.0 | Excellent |
| 120 | 0.55 | 900 | 1,050 | $4.0 \times 10^9$ | $6.0 \times 10^9$ | 3.4 | 5.0 | 0.4 | 1.0 | Excellent |

Table 3-continued

| Heat treating temperature (°C.) | Retention of initiator (%) | Electrification voltage (v) Before washing | Electrification voltage (v) After 30 times washing | Surface resistance (Ω) Before washing | Surface resistance (Ω) After 30 times washing | Half-life period (sec) Before washing | Half-life period (sec) After 30 times washing | Water absorption property (sec) Before washing | Water absorption property (sec) After 30 times washing | Feeling |
|---|---|---|---|---|---|---|---|---|---|---|
| 140 | 0.32 | 950 | 1,100 | $4.5 \times 10^9$ | $8.0 \times 10^9$ | 3.6 | 5.1 | 0.4 | 1.0 | Rigid |

It can be seen from Table 3 that, when the heating temperature in the polymerization initiator treatment is lower than 60° C., the retention of polymerization initiator in the tricot is insufficient, and therefore the effect of the present invention is low, and that when the heat treating temperature is higher than 130° C., the retention of the initiator in the tricot is low and further the feeling of the treated tricot is very rigid.

EXAMPLE 4

The same back half tricot as used in Example 2 was immersed in an aqueous solution containing 0.1% of ammonium ceric nitrate in a bath ratio of 1:10, heated from room temperature up to 110° C. in 30 minutes, heat treated at 110° C. for 45 minutes, taken out from the solution, washed thoroughly with water and dried. Then, the tricot was immersed in an aqueous solution containing 1% of 1,3,5-triacryloylhexahydro-1,3,5-triazine as a water-soluble polymerizable monomer and having a pH of 3 adjusted by the use of phosphoric acid in a bath ratio of 1:100, heated from room temperature up to a heat treating temperature (40°–140° C.) shown in the following Table 4 in about 30 minutes, and heat treated at this temperature for a period of time shown in Table 4. Then, the tricot was taken out from the solution, squeezed, washed with water and dried to obtain a treated tricot. The treated tricot was subjected to a washing test, and the physical properties of the tricot, before and after the washing test, are shown in Table 4.

Table 4

| Heat treating temperature [°C.] | Treating time (min) | Electrification voltage (v) Before washing | Electrification voltage (v) After 30 times washing | Surface resistance (Ω) Before washing | Surface resistance (Ω) After 30 times washing | Half-life period (sec) Before washing | Half-life period (sec) After 30 times washing | Water absorption property (sec) Before washing | Water absorption property (sec) After 30 times washing | Feeling |
|---|---|---|---|---|---|---|---|---|---|---|
| | 240 | 1,600 | 2,200 | $1.2 \times 10^{10}$ | $8.1 \times 10^{10}$ | 8.0 | 15.0 | 2.9 | 3.3 | Somewhat slimy |
| 40 | | | | | | | | | | |
| | 120 | 2,800 | 5,800 | $9.5 \times 10^{11}$ | $7.8 \times 10^{12}$ | 16.0 | 12.5 | 3.5 | 59.0 | Slimy |
| 60 | 120 | 1,000 | 1,600 | $7.9 \times 10^9$ | $1.2 \times 10^{10}$ | 4.2 | 8.2 | 1.2 | 2.9 | Excellent |
| 100 | 60 | 920 | 1,200 | $4.0 \times 10^9$ | $7.0 \times 10^9$ | 3.8 | 5.2 | 0.9 | 1.8 | Excellent |
| | 30 | 940 | 1,200 | $4.2 \times 10^9$ | $7.3 \times 10^9$ | 3.6 | 5.4 | 0.8 | 1.9 | Excellent |
| 120 | 60 | 920 | 1,100 | $4.0 \times 10^9$ | $6.8 \times 10^9$ | 3.9 | 5.2 | 1.0 | 1.3 | Excellent |
| 140 | 30 | 950 | 1,200 | $4.5 \times 10^9$ | $7.8 \times 10^9$ | 4.0 | 5.0 | 1.0 | 1.5 | Rigid |

It can be seen from Table 4 that, when the treating temperature in the monomer treatment is lower than 50° C., the treatment is not effective, and a long time is required in the treatment. While, when the treating temperature exceeds 130° C., the treated tricot is poor in the feeling.

EXAMPLE 5

A plain weave fabric consisting of 52 count acrylic fibers (warp: 137 fibers/inch, weft: 72 fibers/inch) was immersed in a 0.1% aqueous solution of ammonium ceric sulfate, which was used as a polymerization initiator, in a bath ratio of 1:30, heated from room temperature up to 90° C. in 40 minutes while fully stirring, heat treated at 90° C. for 30 minutes, taken out from the solution, washed with water and dried. Then, the above treated fabric was immersed in an aqueous solution containing 1% of 1,3,5-triacryloylhexahydro-1,3,5-triazine as a water-soluble polymerizable monomer and having a pH of 3 adjusted by the use of phosphoric acid, heated from room temperature up to 95° C. in 20 minutes, heat treated at 95° C. for 90 minutes, taken out from the solution, squeezed, washed with water and dried to obtain a treated fabric (Treated fabric No. 1 in the present invention).

The above described treatment was repeated, except that an aqueous solution containing 1% of a mixture, as a water-soluble polymerizable monomer, consisting of 30% of 1,3,5-triacryloylhexahydro-1,3,5-triazine and 70% of bis-polyoxyethylenated bisphenol A diacrylate (repeating units of oxyethylene: 15 moles) was used, to obtain a treated fabric (Treated fabric No. 2 in the present invention).

The resulting treated fabrics and untreated fabric were subjected to a washing test, and the physical properties of the fabrics, before and after the washing test, are shown in the following Table 5.

Table 5

| Sample | Electrification voltage (v) Before washing | Electrification voltage (v) After 30 times washing | Surface resistance (Ω) Before washing | Surface resistance (Ω) After 30 times washing | Half-life period (sec) Before washing | Half-life period (sec) After 30 times washing | Water absorption property (sec) Before washing | Water absorption property (sec) After 30 times washing | Feeling |
|---|---|---|---|---|---|---|---|---|---|
| Treated fabric No. 1 in | 820 | 1,100 | $5.1 \times 10^9$ | $8.3 \times 10^9$ | 3.2 | 5.6 | 0.4 | 1.0 | Excellent |

Table 5-continued

| Sample | Electrification voltage (v) | | Surface resistance (Ω) | | Half-life period (sec) | | Water absorption property (sec) | | Feeling |
|---|---|---|---|---|---|---|---|---|---|
| | Before washing | After 30 times washing | Before washing | After 30 times washing | Before washing | After 30 times washing | Before washing | After 30 times washing | |
| the present invention | | | | | | | | | |
| Treated fabric No. 2 in the present invention | 1,200 | 1,600 | $9.0 \times 10^9$ | $1.2 \times 10^{10}$ | 5.7 | 8.3 | 1.0 | 1.8 | Excellent |
| Untreated fabric | 4,800 | 6,200 | $4.8 \times 10^{12}$ | $8.8 \times 10^{13}$ | 126 | >180 | 61.5 | >180 | Slimy |

What is claimed is:

1. A method of treating fiber made of synthetic polymer or a fabric comprised of said fiber, which comprises the steps of: applying to said fiber a first aqueous solution or an aqueous dispersion containing a heat-stable polymerization initiator and heat treating said fiber in a first heat treating step until from 0.01 to 5 percent by weight of said polymerization initiator, based on the weight of said fiber, penetrates into and is retained in the interior of said fiber; then washing said fiber with water to remove polymerization initiator remaining on the surface of said fiber; then applying to said fiber a second aqueous solution of at least one water-soluble polymerizable monomer capable of being polymerized by contact with said polymerization initiator to form a hydrophilic polymer for imparting a water absorption property and an antistatic property to said fiber, said second aqueous solution having a pH of not higher than 6, and heat treating said fiber in a second heat treating step at a temperature effective to polymerize said monomer to form said hydrophilic polymer wherein said polymerization initiator migrates to the surface of said fiber and said monomer penetrates into the interior of the fiber so that said hydrophilic polymer is formed both in the interior and on the surface of the fiber.

2. A method according to claim 1, wherein said water-soluble polymerizable monomer is N,N'-methylene-bisacrylamide or 1,3,5-triacryloylhexahydro-1,3,5-triazine.

3. A method according to claim 1 or claim 2, wherein the step of applying to said fiber said first aqueous solution or said dispersion containing said polymerization initiator and the first heat treating step are carried out by immersing said fiber in said first aqueous solution or said dispersion containing from 0.002 to 1% by weight of said initiator, and heat treating said fiber while it is immersed in said first aqueous solution or said dispersion.

4. A method according to claim 3, wherein in said first heat treating step, said first aqueous solution or said dispersion is heated at a temperature of from 60° to 130° C. and said fiber is maintained immersed therein for from 2 to 60 minutes.

5. A method according to claim 1 or claim 2, wherein the polymerization initiator is cerium ammonium salt.

6. A method according to claim 1, wherein said second aqueous solution has a monomer concentration of 0.01–5% by weight.

7. A method according to claim 1 or claim 6, wherein the step of applying said second aqueous solution to said fiber and the second heat treating step are carried out by immersing said fiber in said second aqueous monomer solution and heat treating said material while it is immersed in said second aqueous solution.

8. A method according to claim 7, wherein in said second heat treating step, said second aqueous solution is heated at a temperature of from 50° to 130° C.

9. A method according to claim 7, wherein the immersion is carried out in a bath ratio of 1/5–1/300.

10. A method according to claim 1 or claim 6, wherein the step of applying said second aqueous solution to said fiber and the second heat treating step are carried out by applying said second aqueous solution to said fiber by padding or spraying, and then subjecting said fiber to steaming at a temperature of from 50° to 130° C.

11. A method according to claim 10, wherein said second aqueous solution is applied to said fiber in an amount of 0.01 to 5% by weight, calculated as solid monomer base, based on the weight of said fiber.

12. A method according to claim 11, wherein the steaming temperature is 80°–130° C.

13. A method according to claim 1, wherein said fiber is selected from the group consisting of polyamide fiber, polyester fiber, polyacrylonitrile fiber, polyvinyl alcohol fiber, polypropylene fiber, polyethylene fiber, polyvinyl chloride fiber and polyvinylidene chloride fiber.

* * * * *